US008822946B2

(12) United States Patent
Chen

(10) Patent No.: US 8,822,946 B2
(45) Date of Patent: Sep. 2, 2014

(54) SYSTEMS AND METHODS OF VARYING CHARGED PARTICLE BEAM SPOT SIZE

(75) Inventor: Yu-Jiuan Chen, Fremont, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 198 days.

(21) Appl. No.: 13/343,705

(22) Filed: Jan. 4, 2012

(65) Prior Publication Data

US 2012/0181456 A1 Jul. 19, 2012

Related U.S. Application Data

(60) Provisional application No. 61/429,681, filed on Jan. 4, 2011, provisional application No. 61/528,573, filed on Aug. 29, 2011.

(51) Int. Cl.
*H01J 1/50* (2006.01)
*G21K 1/087* (2006.01)

(52) U.S. Cl.
CPC ..... *G21K 1/087* (2013.01)
USPC ..... 250/396 R; 250/283; 250/288

(58) Field of Classification Search
USPC ..... 250/492.2, 492.23, 492.3, 396 ML
See application file for complete search history.

(56) References Cited

U.S. PATENT DOCUMENTS

| | | | | |
|---|---|---|---|---|
| 3,308,323 | A | 3/1967 | Van De Graaff | |
| 6,066,961 | A | 5/2000 | Lee et al. | |
| 6,194,732 | B1 * | 2/2001 | Okino | 250/491.1 |
| 7,576,499 | B2 * | 8/2009 | Caporaso et al. | 315/505 |
| 7,710,051 | B2 * | 5/2010 | Caporaso et al. | 315/505 |
| 7,982,183 | B2 | 7/2011 | Makarov et al. | |
| 8,148,679 | B2 | 4/2012 | Makarov et al. | |
| 8,148,680 | B2 | 4/2012 | Makarov et al. | |
| 2007/0145916 | A1 * | 6/2007 | Caporaso et al. | 315/505 |
| 2009/0224700 | A1 * | 9/2009 | Chen et al. | 315/505 |
| 2010/0032580 | A1 * | 2/2010 | Caporaso et al. | 250/396 R |
| 2010/0059665 | A1 * | 3/2010 | Sampayan | 250/251 |
| 2010/0060207 | A1 * | 3/2010 | Caporaso et al. | 315/505 |
| 2012/0168639 | A1 | 7/2012 | Chen | |
| 2013/0140468 | A1 | 6/2013 | Chen | |

OTHER PUBLICATIONS

Caporaso, G.J., et. al., "High Gradient Induction Accelerator," Proceedings of PAC07, Albuquerque, New Mexico, USA, TUYC02, pp. 857-861, Jun. 2007.

Chen, Y.-J., et al., "Beam Transport in a Proton Dielectric Wall Accelerator," Proceedings of Linear Accelerator Conference LINAC2010, Tsukuba, Japan, THP086, pp. 941-943, Sep. 2010.

(Continued)

*Primary Examiner* — Nikita Wells
*Assistant Examiner* — Johnnie L Smith
(74) *Attorney, Agent, or Firm* — Perkins Coie LLP

(57) ABSTRACT

Methods and devices enable shaping of a charged particle beam. A modified dielectric wall accelerator includes a high gradient lens section and a main section. The high gradient lens section can be dynamically adjusted to establish the desired electric fields to minimize undesirable transverse defocusing fields at the entrance to the dielectric wall accelerator. Once a baseline setting with desirable output beam characteristic is established, the output beam can be dynamically modified to vary the output beam characteristics. The output beam can be modified by slightly adjusting the electric fields established across different sections of the modified dielectric wall accelerator. Additional control over the shape of the output beam can be excreted by introducing intentional timing de-synchronization offsets and producing an injected beam that is not fully matched to the entrance of the modified dielectric accelerator.

40 Claims, 14 Drawing Sheets

(56) References Cited

OTHER PUBLICATIONS

Chen, Y.-J., et al., "Compact Proton Accelerator for Cancer Therapy," Proceedings of PAC07, Albuquerque, New Mexico, USA, TUPAS059, pp. 1787-1789, Jun. 2007.

Syms, R.R.A., et al., "Two-dimensional microfabricated electrostatic einzel lens," Sensors and Actuators A: Physical, 107(3):285-295, Nov. 2003.

* cited by examiner

SYSTEMS AND METHODS OF VARYING CHARGED PARTICLE BEAM SPOT SIZE

CROSS-REFERENCE TO RELATED APPLICATIONS

This patent document claims the benefits and priorities of U.S. Provisional Application No. 61/528,573, filed on Aug. 29, 2011, and U.S. Provisional Application No. 61/429,681, filed on Jan. 4, 2011, which are hereby incorporated by reference.

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

TECHNICAL FIELD

This patent document generally relates to particle accelerators, including linear particle accelerators that use dielectric wall accelerators.

BACKGROUND

Particle accelerators are used to increase the energy of electrically-charged atomic particles, e.g., electrons, protons, or charged atomic nuclei. High energy electrically-charged atomic particles are accelerated to collide with target atoms, and the resulting products are observed with a detector. At very high energies the charged particles can break up the nuclei of the target atoms or molecules and interact with other particles. Transformations are produced that help to discern the nature and behavior of fundamental units of matter. Particle accelerators are also important tools in the effort to develop nuclear fusion devices, as well as in medical applications such as proton therapy for cancer treatment.

Proton therapy uses a beam of protons to irradiate diseased tissue, most often in the treatment of cancer. The proton beams can be utilized to more accurately localize the radiation dosage and provide better targeted penetration inside the human body when compared with other types of external beam radiotherapy. Due to their relatively large mass, protons have relatively small lateral side scatter in the tissue, which allows the proton beam to stay focused on the tumor with only low-dose side-effects to the surrounding tissue.

The radiation dose delivered by the proton beam to the tissue is at or near maximum just over the last few millimeters of the particle's range, known as the Bragg peak. Tumors closer to the surface of the body are treated using protons with lower energy. To treat tumors at greater depths, the proton accelerator must produce a beam with higher energy. By adjusting the energy of the protons during radiation treatment, the cell damage due to the proton beam is maximized within the tumor itself, while tissues that are closer to the body surface than the tumor, and tissues that are located deeper within the body than the tumor, receive reduced or negligible radiation.

Proton beam therapy systems are traditionally constructed using large accelerators that are expensive to build and hard to maintain. However, recent developments in accelerator technology are paving the way for reducing the footprint of the proton beam therapy systems that can be housed in a single treatment room. Such systems often require newly designed, or re-designed, subsystems that can successfully operate within the small footprint of the proton therapy system, reduce or eliminate health risks for patients and operators of the system, and provide enhanced functionalities and features.

SUMMARY

The technology described in this patent document includes devices, systems and methods for varying beam spot size of a charged particle beam in particle accelerators, including linear particle accelerators that use dielectric wall accelerators.

In one implementation, a charged particle accelerator system is provided to include a dielectric wall accelerator (DWA) including a high gradient lens section that transports a charged particle beam and controls a beam spot size of the charged particle beam, and a main DWA section that accelerates the charged particle beam. The high gradient lens section and the main DWA section include a series of alternating layers of insulators and conductors with a hollow center, the series of alternating layers stacked together to form a single high gradient insulator (HGI) tube to allow propagation of the charged particle beam through the hollow center of the HGI tube. The DWA includes a plurality of transmission lines connected to the high gradient lens section; a plurality of transmission lines connected to the main DWA section and one or more voltage sources configured to supply an adjustable voltage value to each transmission line of the plurality of transmission lines connected to the high gradient lens section and the main DWA section.

In another implementation, a method of shaping a charged particle beam is provided to include establishing a desired electric field across a plurality of sections of a dielectric wall accelerator (DWA). The DWA includes a high gradient lens section and a main DWA section. The high gradient lens section and the main DWA section include a series of alternating layers of insulators and conductors with a hollow center, the series of alternating layers stacked together to form a single high gradient insulator (HGI) tube to allow propagation of a charged particle beam through the hollow center of the HGI tube. The DWA includes a plurality of transmission lines connected to the high gradient lens section, a plurality of transmission lines connected to the main DWA section, and one or more voltage sources configured to supply an adjustable voltage value to each transmission line of the plurality of transmission lines connected to the high gradient lens section and the main dielectric wall section. The method includes directing the charged particle beam through the DWA.

In yet another implementation, a method is provided for treatment of a patient using a charged particle accelerator system. This method includes irradiating one or more target areas within the patient's body with a charged particle beam that is output from the charged particle beam accelerator system. The charged particle accelerator system includes a charged particle source and a dielectric wall accelerator (DWA). The DWA includes a high gradient lens section and a main DWA section. The high gradient lens section and the main DWA section include a series of alternating layers of insulators and conductors with a hollow center, the series of alternating layers are stacked together to form a single high gradient insulator (HGI) tube to allow propagation of a charged particle beam through the hollow center of the HGI tube. The DWA includes a plurality of transmission lines connected to the high gradient lens section, a plurality of transmission lines connected to the main DWA section, and one or more voltage sources configured to supply an adjustable voltage value to each transmission line of the plurality of transmission lines connected to the high gradient lens section and the main dielectric wall section. The charged particle accelerator system further includes a timing and control component configured to produce timing and control signals to the charged particle source, the high gradient lens and the dielectric wall accelerator. The disclosed method includes adjusting the one or more voltage sources to supply a first set of voltage values to the high gradient lens section and the main DWA section to produce an output charged particle beam with a particular set of baseline characteristics.

These and other implementations and various features and operations are described in greater detail in the drawings, the description and the claims.

BRIEF DESCRIPTION OF THE DRAWINGS

FIG. 3(*b*) illustrates longitudinal decompression and transverse focusing of a charged particle beam in a dielectric wall accelerator.

FIG. 7(*b*) is a plot of an output charged particle beam's $1-\sigma$ energy at a target location as a function of an injected beam's envelope slope that can be produced in accordance with an exemplary embodiment of the described technology.

FIG. 7(*c*) is a plot of an output charged particle beam's radius at a target location as a function of an injected beam's envelope slope that can be produced in accordance with an exemplary embodiment of the described technology.

FIG. 7(*d*) is a plot of an output charged particle beam's r.m.s. radius at a target location as a function of an injected beam's envelope slope that can be produced in accordance with an exemplary embodiment of the described technology.

FIG. 7(*e*) is a plot of an output charged particle beam's envelope slope at a target location as a function of an injected beam's envelope slope that can be produced in accordance with an exemplary embodiment of the described technology.

FIG. 7(*f*) is a plot of an output charged particle beam's Lapostolle emittance at a target location as a function of an injected beam's envelope slope that can be produced in accordance with an exemplary embodiment of the described technology.

FIG. 9(*b*) is a plot of an output charged particle beam's slope at a target location as a function of the location of a misfired Blumlein device that can be produced in accordance with an exemplary embodiment of the described technology.

FIG. 9(*c*) is a plot of an output charged particle beam's Lapostolle emittance at a target location as a function of the location of a misfired Blumlein device in accordance with an exemplary embodiment of the described technology.

FIG. 9(*d*) is a plot of an output charged particle beam's energy at a target location as a function of the location of a misfired Blumlein device that can be produced in accordance with an exemplary embodiment of the described technology.

DETAILED DESCRIPTION

The devices, systems and methods and their implementations disclosed in this patent document provide mechanisms to vary spot sizes of charged particle beams in dielectric wall accelerators. This capability of varying beam spot sizes of charged particle beams rapidly and dynamically can be advantageous in various applications, including, for example, increasing the effectiveness of radiation therapy. In implementations, the output charged particle beam of the dielectric wall accelerators, e.g., proton or electron beams, can use the varying beam spot sizes to achieve desired focusing and defocusing of the charged particle beam at a target.

Figure 1:
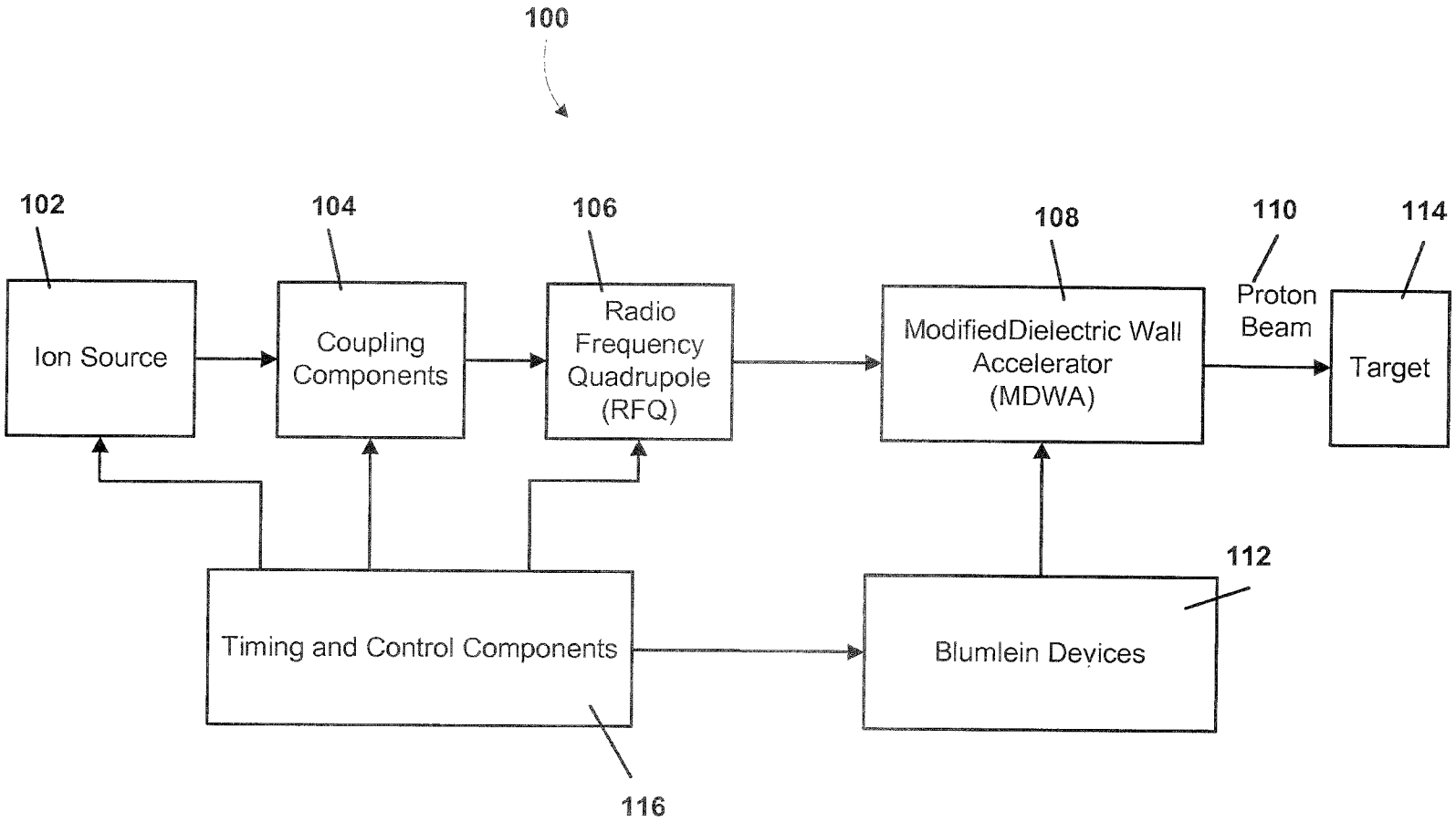
FIG. 1 is a block diagram of a linear particle accelerator that can accommodate the disclosed embodiments of the described technology.

FIG. 1 illustrates a simplified diagram of a linear particle accelerator (linac) 100 that can accommodate the disclosed embodiments. For simplicity, FIG. 1 only depicts some of the components of the linac 100. Therefore, it is understood that the linac 100 can include additional components that are not specifically shown in FIG. 1. It should also be noted that while some of the disclosed embodiments are described in the context of the exemplary linear accelerator 100 of FIG. 1, it is understood that the disclosed embodiments can be used in other systems and in conjunction with other applications that can benefit from a modified dielectric wall accelerator that enables dynamic modifications of a charged particle beam.

Referring back to FIG. 1, a charged particle source, such as exemplary ion source 102, produces a charged particle beam that is coupled to a radio frequency quadrupole (RFQ) 106 using coupling components 104. The coupling components 104 can, for example, include components such as one or more Einzel lenses that provide a focusing/defocusing mechanism for the charged particle beam that is input to the RFQ 106. The RFQ 106 provides focusing, bunching and acceleration for the charged particle beam. One exemplary configuration of a radio frequency quadrupole includes an arrangement of four triangular-shaped vanes that form a small hole, through which the proton beam passes. The edges of the vanes at the central hole include ripples that provide acceleration and shaping of the beam. The vanes are RF excited to accelerate and shape the ion beam passing therethrough.

In the specific example in FIG. 1, the charged particle beam output by RFQ 106 is coupled to a modified dielectric wall accelerator (MDWA) 108 in accordance with the disclosed embodiments of the described technology. The MDWA 108 further accelerates the beam to produce an output charged particle beam, shown as an exemplary proton beam 110. The MDWA 108 can also dynamically shape the charged particle beam so as to provide focusing, defocusing, spot size variations, and other modifications to the charged particle beam. The output charged particle beam (e.g., the proton beam 110) is delivered to the target 114, such as a tumor within a patient's body in cancer therapy applications. FIG. 1 also shows Blumlein devices 112 that are used to deliver voltage pulses to the MDWA 108. The timing and control components 116 provide the necessary timing and control signals to the various components of the linac 100 to ensure proper operation and synchronization of those components. For example, the timing and control components 116 can be used to control the timing and value of voltages that are applied to the MDWA 108. As will be described in the sections that follow, the control and timing components 116 can provide different timing and voltage control signals for application to different sections of the MDWA 108.

Figure 2A:
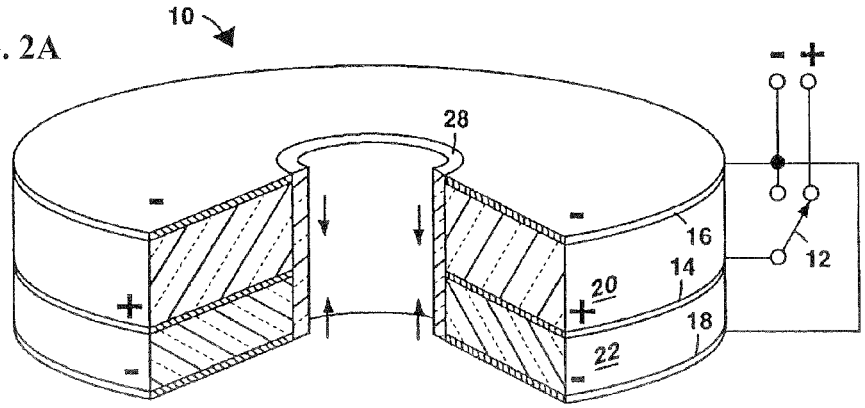
FIGS. 2A, 2B, 2C and 2D illustrate the structure and operations of a dielectric wall accelerator that can be used in conjunction with the disclosed embodiments of the described technology.
Figure 2B:
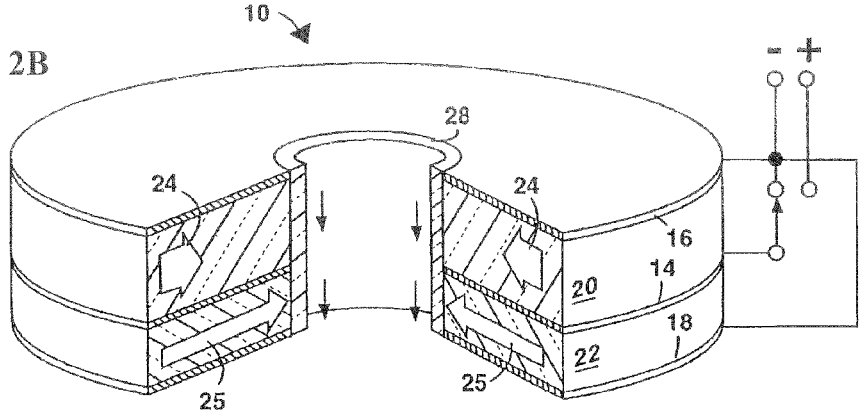
Figure 2C:
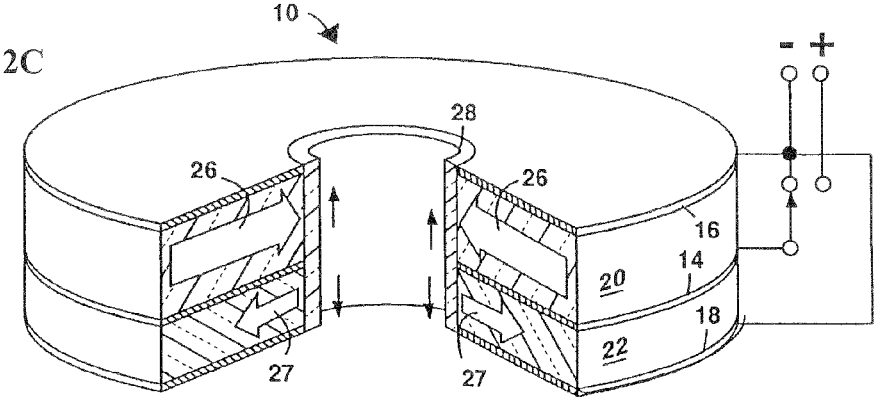
Figure 2D:
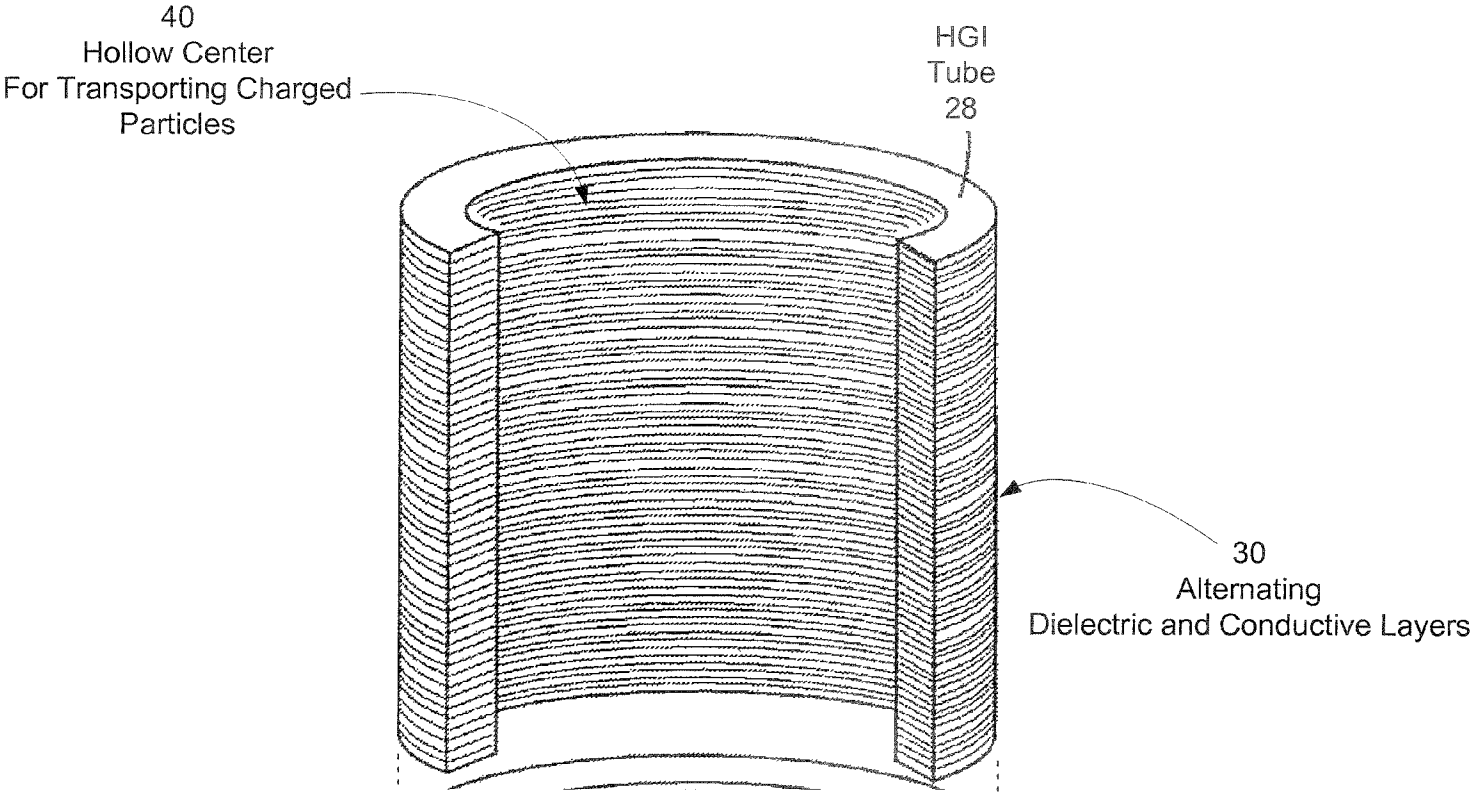

FIG. 2A, FIG. 2B, FIG. 2C and FIG. 2D provide exemplary diagrams that illustrate the structure and operation of a single DWA cell 10 that can be utilized with the linac 100 of FIG. 1. FIGS. 2A-2C provide a time-series that is related to the state of a switch 12. As shown in FIGS. 2A-2C, a sleeve 28 fabricated from a dielectric material is molded or otherwise formed on the inner diameter of the single accelerator cell 10 to provide a dielectric wall of an acceleration tube. FIG. 2D shows an example of the dielectric sleeve 28 of the DWA in a high gradient insulator (HGI) structure, which is a layered insulator 30 having alternating electrically conductive materials (e.g., metal conductors) and dielectric materials. The HGI structure 30 in this example is made of alternating dielectric and conductive disk layers to form a HGI tube with a hollow center 40 for transporting the charged particles. This HGI structure is capable of withstanding high voltages generated by the Blumlein devices and, therefore, provides a suitable dielectric wall of the accelerator tube. The charged particle beam is introduced at one end of the accelerator tube for acceleration along the central axis of the HGI tube.

As shown in FIGS. 2A, 2B and 2C, the switch 12 and conductive transmission lines 16, 14 and 18 are connected to the HGI tube 28 to allow the middle transmission line 14 to be charged by a high voltage source. The conductive transmission lines 16, 14 and 18 are shown as conductive rings or plates in this specific example, but can be alternatively implemented in various transmission line geometries other than the rings or plates. Each of the conductive transmission lines 16, 14 and 18 is in electrical contact with a respective conductive layer of the alternating conductive and dielectric layers in the HGI tube 28. A laminated dielectric 20 with a relatively high dielectric constant separates the conductive plates 14 and 16 and forms the top half of the DWA cell 10 with the conductive plates 14 and 16. A laminated dielectric 22 with a relatively low dielectric constant separates the conductive plates 14 and 18 and forms the bottom half of the DWA cell 10 with the conductive plates 14 and 18. In the exemplary diagram of FIGS. 2A-2C, the middle conductive plate 14 is set closer in distance to the bottom conductive plate 18 than to the top conductive plate 16, such that the combination of the different spacing and the different dielectric constants results in the same characteristic impedance on both sides of the middle conductive plate 14. Although the characteristic impedance may be the same on both halves, the propagation velocity of signals through each half is not the same. The propagation velocity of an applied signal in the higher dielectric constant half with laminated dielectric 20 is slower. This difference in relative propagation velocities is represented by a short fat arrow 24 and a long thin arrow 25 in FIG. 2B, and by a long fat arrow 26 and a reflected short thin arrow 27 in FIG. 2C. In some systems, the Blumleins comprise a linear-folded arrangement with the same dielectric on both halves and different lengths from switch to gap.

In a first position of the switch 12, as shown in FIG. 2A, both halves are oppositely charged so that there is no net voltage along the inner length of the assembly. After the lines have been fully charged, the switch 12 closes across the outside of both lines at the outer diameter of the single accelerator cell, as shown in FIG. 2B. This causes an inward propagation of the voltage waves 24 and 25 which carry opposite polarity to the original charge such that a zero net voltage will be left behind in the wake of each wave. When the fast wave 25 hits the inner diameter of its line, it reflects back from the open circuit it encounters. Such reflection doubles the voltage amplitude of the wave 25 and causes the polarity of the fast line to reverse. For only an instant moment more, the voltage on the slow line at the inner diameter will still be at the original charge level and polarity. As such, after the wave 25 arrives but before the wave 24 arrives at the inner diameter, the field voltages on the inner ends of both lines are oriented in the same direction and add to one another, as shown in FIG. 2B. Such adding of fields produces an impulse field that can be used to accelerate a beam. The impulse field is neutralized, however, when the slow wave 24 eventually arrives at the inner diameter, and is reflected. This reflection of the slow wave 24 reverses the polarity of the slow line, as is illustrated in FIG. 2C. The time that the impulse field exists can be extended by increasing the distance that the voltage waves 24 and 25 must traverse. One way is to simply increase the outside diameter of the single accelerator cell. Another, more compact way is to replace the solid discs of the conductive plates 14, 16 and 18 with one or more spiral conductors that are connected between conductor rings at the inner and/or outer diameters.

Multiple DWA cells 10 may be stacked or otherwise arranged over a continuous dielectric wall, to accelerate the proton beam using various acceleration methods. For example, multiple DWA cells may be stacked and configured to produce together a single voltage pulse for single-stage acceleration. In another example, multiple DWA cells may be sequentially arranged and configured for multi-stage acceleration, wherein the DWA cells independently and sequentially generate an appropriate voltage pulse. For such multi-stage DWA systems, by appropriately timing the closing of the switches (as illustrated in FIGS. 2A to 2C), the generated electric field on the dielectric wall can be made to move at any desired speed. In particular, such a movement of the electric field can be made synchronous with the charged particle beam pulse that is input to the DWA, thereby accelerating the charged particle beam in a controlled fashion that resembles a traveling wave propagating down the DWA axis. The charged particle beam that travels within the DWA in the above fashion is sometimes referred to a "virtual traveling wave."

To attain the highest accelerating gradient in the DWA, the accelerating voltage pulses that are applied to consecutive sections of the DWA should have the shortest possible duration since the DWA can withstand larger fields for pulses with narrow durations. This can be done by appropriately timing the switches in the transmission lines that feed the continuous HGI tube of the DWA. The short accelerating voltage pulses tend to have little or no flattop, which can lead to undesirable charged particle beam spot size and emittance growth. In the middle of the DWA, at the time when a particular section of the DWA is charged to accelerate the particle beam bunch, the high gradient insulator sections immediately before and after the charged section are also at least partially charged, and the corresponding charged particle beam is at least partially excited, due to the finite traveling speed of the charged particle bunch and the non-zero voltage pulse width that is applied to the DWA section. At the two ends of the DWA, however, only one of the upstream or the downstream sections of the HGI/associated charged particle bunch is charged/excited depending on whether the charged particle beam is at the entrance or exit of the DWA, respectively. Therefore, assuming that the characteristic length for an excited section of the HGI is L, the length of the excited HGI section at the two ends of the DWA is shorter than L, and the virtual traveling wave buckets (i.e., the accelerating fields that move the charged particle beam down the DWA) at the entrance and exit of the DWA are generally much shorter compared to the wave buckets in the middle of the DWA.

To facilitate the understanding of the disclosed embodiments, it is instructive to analyze the longitudinal electric field along the z-axis (e.g., the direction in which the charged particle beam is traveling) as a function of time, t, as give by Equation (1) below.

$$E_z(z, t) = \tilde{E}(z) f\left(t - \int_{z0}^{z} \frac{dz'}{v}\right). \tag{1}$$

In Equation (1), $\tilde{E}(z)$ is the field gradient of the electric field and $$f\left(t - \int_{z0}^{z} \frac{dz'}{v}\right)$$

describes the electric field's waveform and its field package moving down the z-axis with velocity, v. With $\nabla \cdot \vec{E} = 0$, the corresponding radial electric field at a radial position, r, within the HGI tube, is much less than $$\frac{E_z}{\left|\frac{\partial E_z}{\partial z}\right|},$$

is given by Equation (2).

$$E_r(z, t) \approx -\frac{r}{2} \frac{\partial E_z(z, t)}{\partial z}. \tag{2}$$

Combining Equations (1) and (2) produces the following expression for the radial electric field.

$$E_r(z, t) \approx -\frac{r}{2}\left[\tilde{E}'(z) f(z - vt) + \tilde{E}(z) \frac{df}{dt} \Big/ v\right]. \tag{3}$$

In Equation (3), the term $\tilde{E}'(z)$, represents the derivative of $\tilde{E}(z)$ with respect to z. It should be further noted that in order to facilitate the understanding of the disclosed embodiments, Equations (2) to (4) have been presented to include a radial electric field based on the simplifying assumption that the transverse electric field is radially symmetric. However, the disclosed embodiments are also applicable to transverse electric fields that are not radially symmetric. In those cases, the transverse electric field computations can be carried out using the x- and the y-components.

If the traveling field's gradient $\tilde{E}(z)$ remains the same along the z-axis and the accelerating field pulse has no flattop, the particle beam bunch experiences transverse focusing and defocusing fields. Depending on the relative position of the charged particle beam that is propagating in the DWA with respect to the peak of the electric field waveform, the short accelerating field pulse will provide different radial focusing or defocusing forces on the charged particles. For example, the charged particles can be either simultaneously transversely defocused and longitudinally compressed, or can be transversely focused and longitudinally decompressed.

Figure 3:
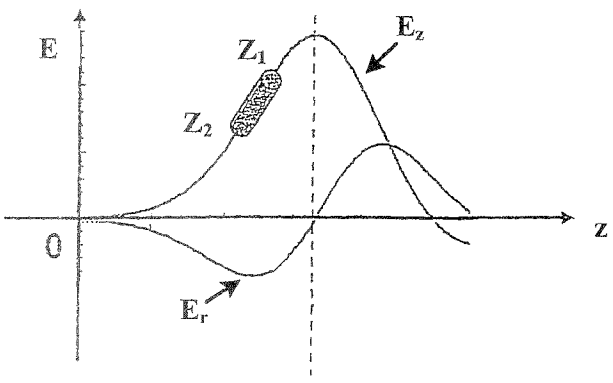
FIG. 3(*a*) illustrates longitudinal compression and transverse defocusing of a charged particle beam in a dielectric wall accelerator.
Figure 3:
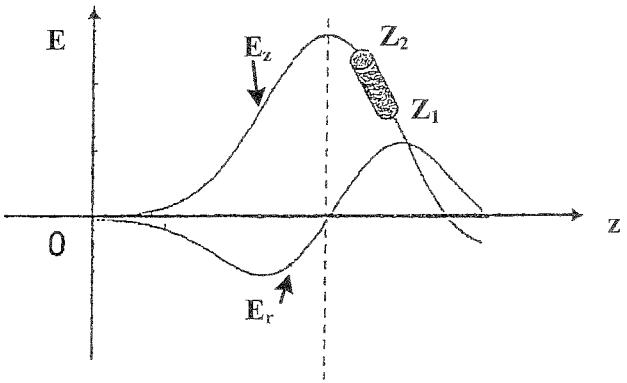

FIG. 3(*a*) illustrates an exemplary scenario, where the charged particle bunch, having an extent that spans from $z_1$ to $z_2$, is longitudinally compressed ($E_r>0$) but is transversely defocused ($E_z(z_2,t)>E_z(z_1,t)$). FIG. 3(*b*) illustrates a different scenario, in which the charged particle bunch is longitudinally decompressed ($E_r<0$) but is transversely focused ($E_z(z_2,t)<E_z(z_1,t)$). Therefore, for a charged particle bunch with a finite length that is traveling in a short accelerating bucket, the head and the tail of the bunch can experience different transverse kicks that can result in emittance growth and larger spot sizes at the target. While the spot size may be reduced by placing lenses between the DWA and the target, such lenses are often large in size to accommodate the large focusing field required for the full energy charged particle beam, and further increase the complexity and length of the accelerator system.

The effects of the dispersive radial kicks, such as the ones that are illustrated in FIGS. 3(*a*) and 3(*b*), can be minimized by increasing the accelerating field's pulse length at the DWA entrance as long as practically possible at the time when the charged particle beam is entering the DWA. This pulse widening can be done by, for example, using a grid or foil at the DWA entrance and widening the length of the excited DWA section by simultaneously charging several contiguous sections of the DWA. The grid can then be removed and the pulse length can be reduced once the charged particle bunch has passed through the entrance area of the DWA. However, in such a scenario, the longitudinal extent of the wave bucket at the entrance may still not be long enough to transport the finite length particle beam bunch without significant transverse kicks.

Examination of Equation (3) reveals that an additional radial electric field control capability can be implemented through the first term on the right hand side of Equation (3). To this end, in some embodiments, a modified DWA (MDWA) is provided to allow a portion of the DWA to operate as a high gradient dynamic lens, with focusing and defocusing capabilities. In other embodiments, a high gradient dynamic lens separate from the DWA can be provided to modify the focusing of the charged particle beam at the entrance of the DWA.

High gradient lenses described in this patent document can be implemented based on a series of alternating layers of insulators and conductors that are stacked to one another to form a high gradient insulator (HGI) tube. Such a HGI tube includes sections with a hollow center to allow propagation of a charged particle beam of charged particles through the hollow center. Electrically conductive transmission lines are connected to the sections of the HGI tube to apply control voltages to the HGI tube. A lens control module, which can be one or more voltage sources, is configured to supply adjustable control voltages the transmission lines, respectively, to thereby establish an adjustable electric field profile over the sections of the HGI tube to effectuate a lens that modifies spatial profile of the charged particle beam at an output of the HGI tube to achieve a desired beam focusing or defocusing operation. This adjustable HGI tube is a charged particle transport device that allows adjusting the voltages to modify the particle propagation and energy parameters as the particles pass through the HGI tube. Therefore, a HGI lens is an adjustable charged particle lens and allows the same lens structure to provide various lens operations that may be difficult to achieve with a single lens in other lens designs. The HGI tube and the transmission line for the high gradient lenses can be implemented in ways similar to the HGI tube structure for DWA as described above.

Figure 4:
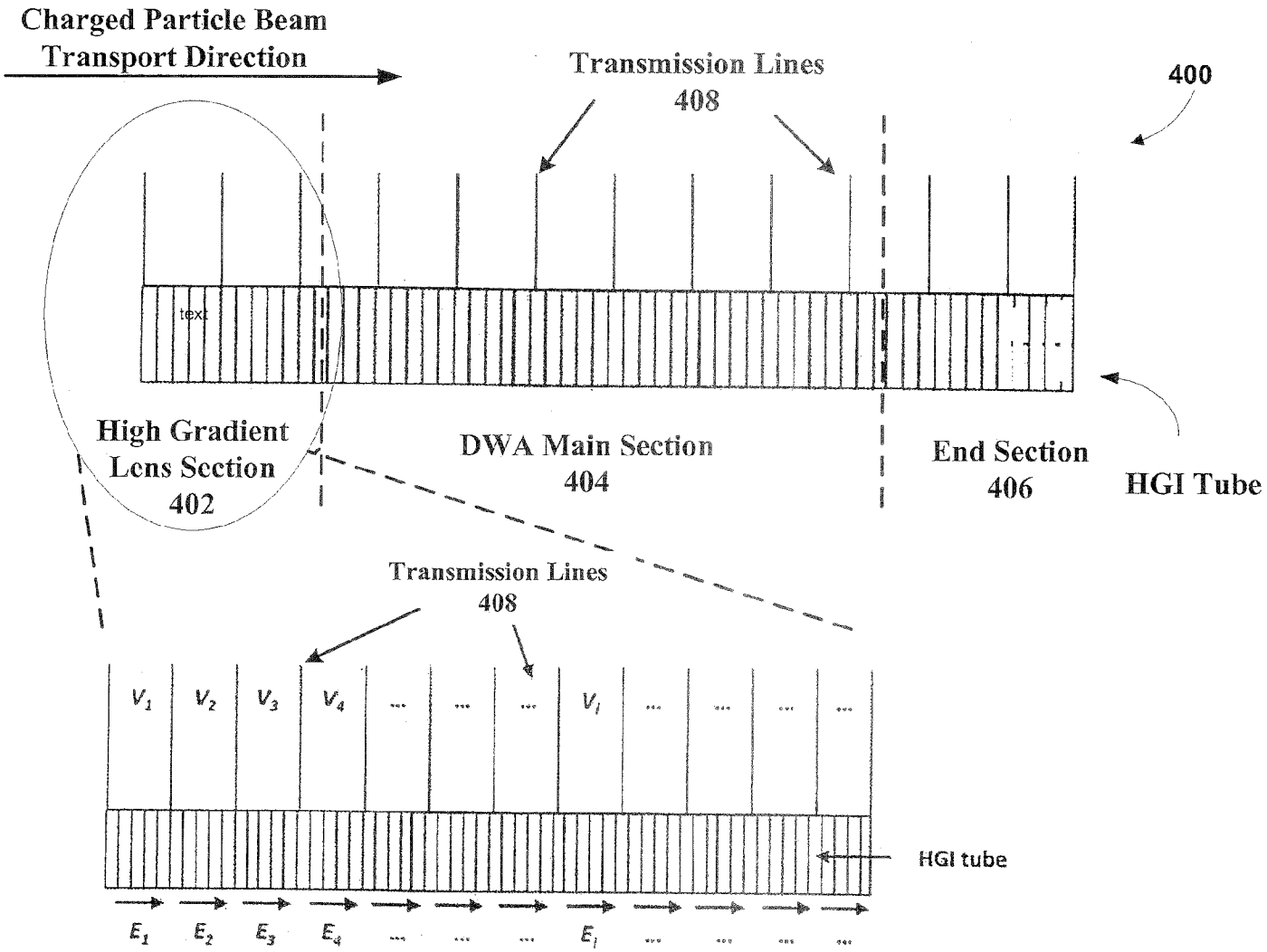
FIG. 4 illustrates a modified dielectric wall accelerator in accordance with an exemplary embodiment of the described technology.

FIG. 4 illustrates a modified dielectric wall accelerator (MDWA) 400 in accordance with an exemplary embodiment of the described technology. The MDWA 400 includes a high gradient lens section 402, a main DWA section 404 and an end section 406. The operations of the main DWA section 404 were previously described in connection with FIGS. 2(A) to 2(C). Further details regarding the end section 406 will be described in the sections that follow. The high gradient lens section 402 of the MDWA 400 is further illustrated at the bottom of FIG. 4 as comprising a stack of alternate layers of insulators and conductors with a hollow center that form a high gradient insulator (HGI) tube, represented by a cross-section of an upper wall of the HGI tube. The voltage pulses $V_1, V_2, \ldots, V_I$ are supplied to the HGI tube by a series of transmission lines 408. In one example embodiment, thickness of the transmission lines 408 is in the order of a few millimeters. In some embodiments, each transmission line can be charged by its own dedicated charging system, whereas in other embodiments, several transmission lines 408 can form a block that is charged by a common charging system. Each of the voltages $V_1, V_2, \ldots, V_I$ produces an associated electric field $E_1, E_2, \ldots, E_I$ in the corresponding section of the HGI tube.

In accordance with the disclosed embodiments, by varying the transmission lines' 408 voltages $V_1, V_2, \ldots, V_I$ from one section to the next section of the HGI tube, a variation of both the electric field gradient or intensity, and the electric field profile is effectuated. Therefore, by adjusting the voltage values that are supplied to the high gradient lens section 402, any desired electric field can be established at the entrance of the MDWA 400. For example, referring back to Equation (2), it is evident that if $$\frac{\partial E_z(z, t)}{\partial z}$$

remains constant, the radial electric field is perfectly linear and, therefore, a linear lens with little or no aberrations is produced. In practical implementations, however, it is often not feasible to produce a perfectly linear longitudinal electric field variation. Therefore, a substantially linear lens is often produced.

Figure 5:
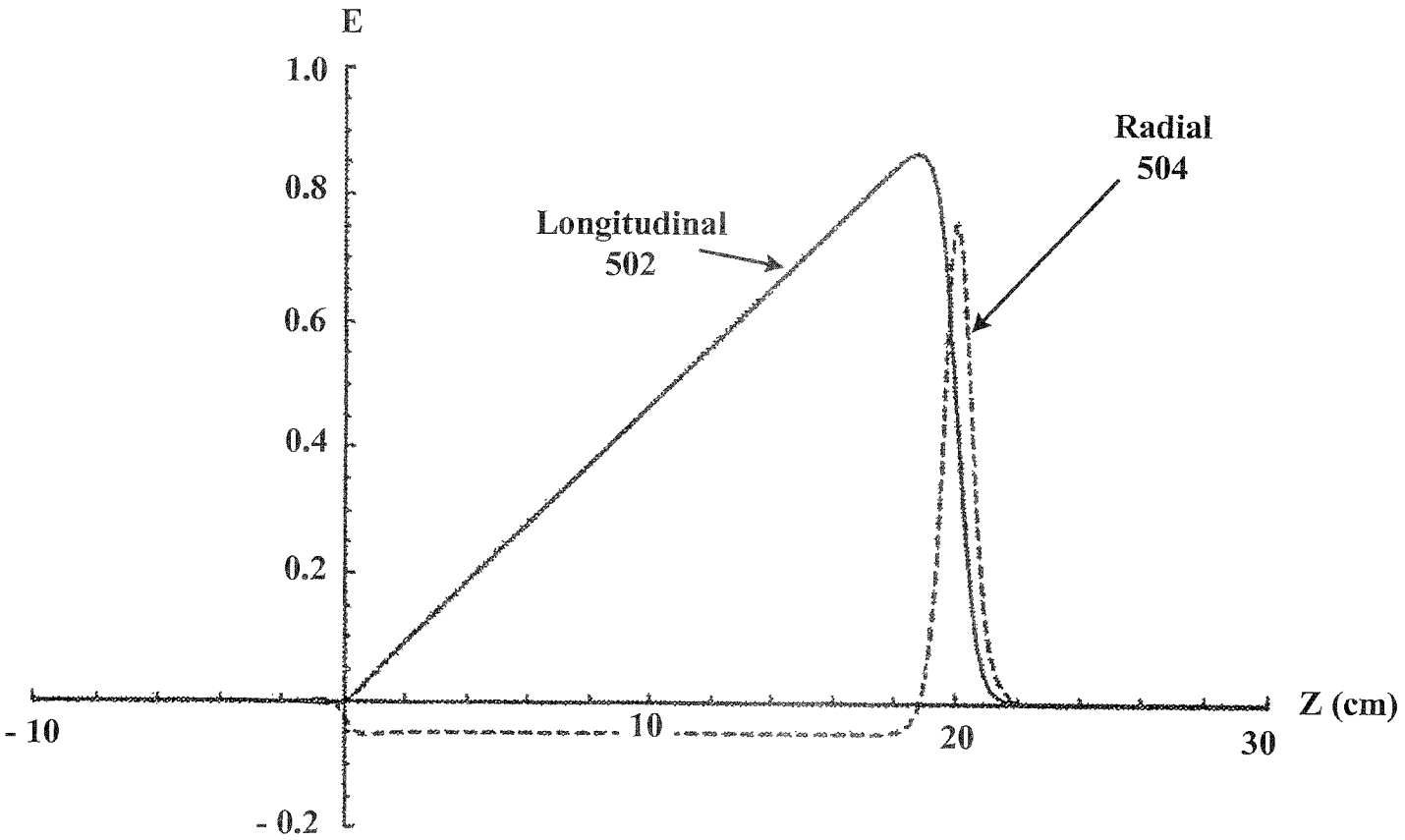
FIG. 5 is a plot of longitudinal and radial electric fields produced in accordance with an exemplary embodiment of the described technology.

In one example embodiment, the high gradient lens section 402 of the MDWA is configured to accelerate and focus the charged particle beam that travels through the HGI tube. FIG. 5 is a plot of longitudinal and radial electric fields produced in accordance with an exemplary embodiment. The plot in FIG. 5 illustrates the longitudinal 502 and radial 504 electric fields as a function of distance along the z-axis that are produced by applying voltages to a 20-cm long high gradient lens section of the MDWA. The electric fields that are illustrated in FIG. 5 accelerate and focus a positively charged particle beam that traverses through the high gradient lens. Similarly, the exemplary electric fields that are illustrated in FIG. 5 operate to decelerate and defocus a negatively charged particle beam that propagates through the high gradient lens.

Figure 6:
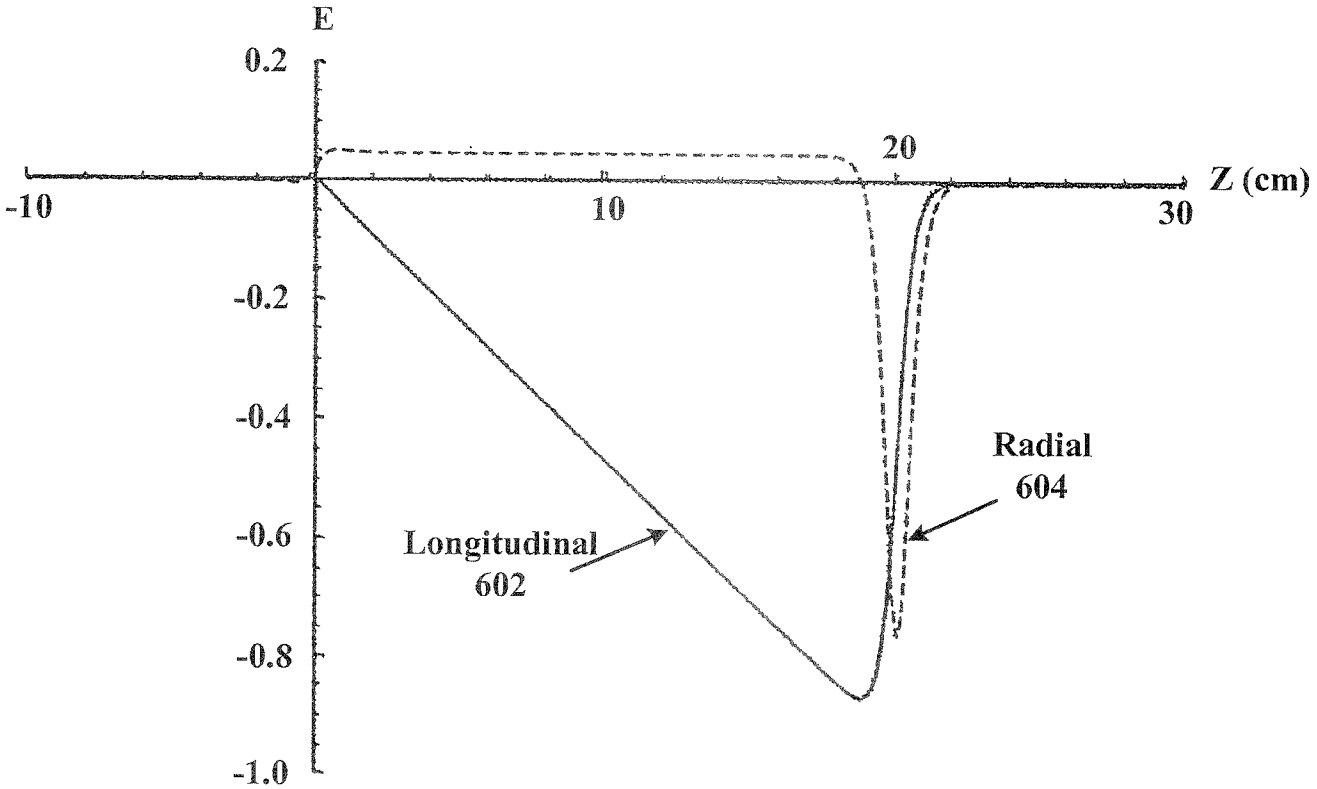
FIG. 6 is a plot of longitudinal and radial electric fields produced in accordance with another exemplary embodiment of the described technology.
Figure 7A:
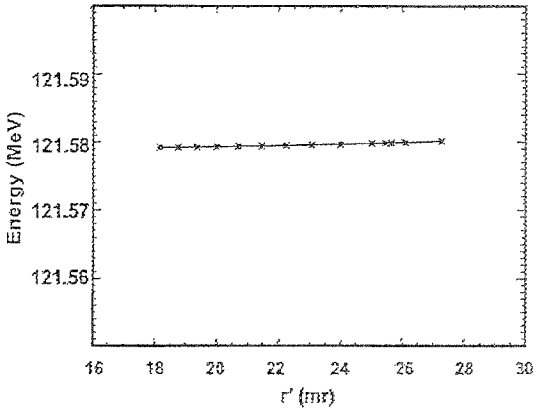
FIG. 7(*a*) is a plot of an output charged particle beam's energy at a target location as a function of an injected beam's envelope slope that can be produced in accordance with an exemplary embodiment of the described technology.
Figure 7B:
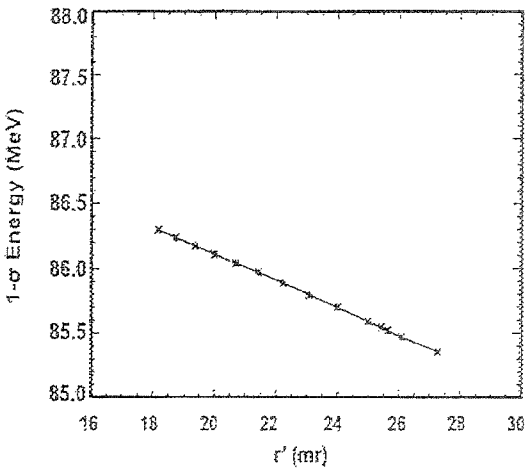
Figure 7C:
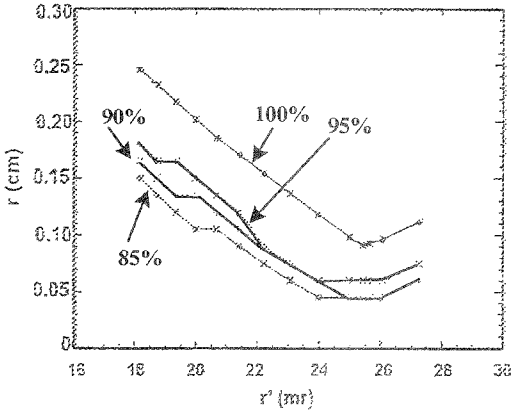
Figure 7D:
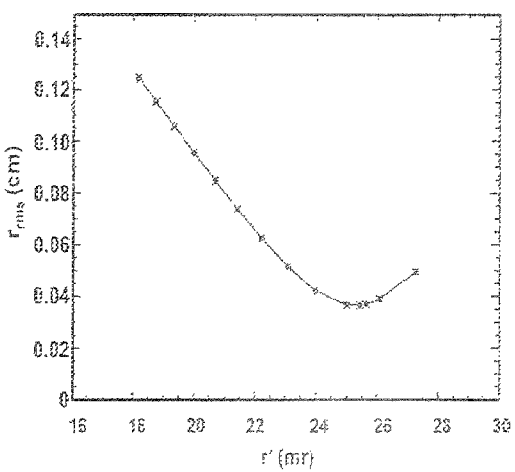
Figure 7E:
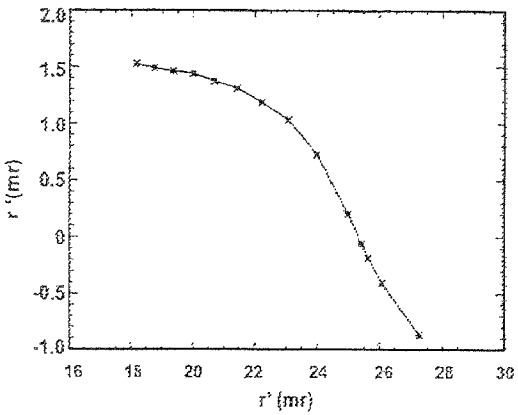
Figure 7F:
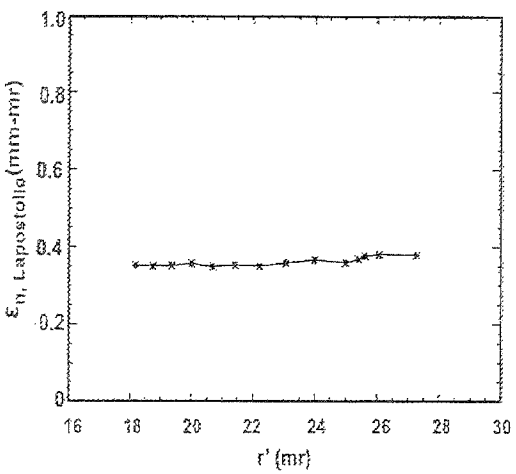

FIG. 6 is a plot of longitudinal and radial electric fields produced in accordance with another exemplary embodiment. The plots in FIG. 6 illustrate the longitudinal 602 and radial 604 electric fields as a function of distance along the z-axis that are produced by applying voltages to a 20-cm long high gradient lens section of the MDWA. The electric fields that are illustrated in FIG. 6 have the opposite polarity of the electric fields that are depicted in FIG. 5 and, as such, they decelerate and defocus a positively charged particle beam that traverses through the high gradient lens. Similarly, the exemplary electric fields that are illustrated in FIG. 6 operate to accelerate and focus a negatively charged particle beam that propagates through the high gradient lens.

The high gradient lens section 402 of the MDWA 400 can, therefore, provide be configured to focus and accelerate a charged particle beam bunch before it reaches the DWA main section 404. As a result, the effects of transverse radial kicks at the entrance of a DWA without the high gradient lens section 402 are minimized. Incorporating the high gradient lens section 402 as part of the MDWA 400 also eliminates a need for having external lenses such as bulky magnetic lenses or electrode-based electrostatic lenses and, therefore, simplifies the design, manufacturing and maintenance of the particle accelerator system. It should be noted that the high gradient lens can be incorporated into various sections of the DWA. In various designs, the strongest focusing fields can be generated if the high gradient lens is located at the entrance of the DWA since the electric field can be ramped up from zero to its maximum allowable value.

When operating a particle accelerator system, such as the particle accelerator 100 of FIG. 1, that is equipped with the MDWA, a matched charged particle beam can be focused to the tightest required spot on a target (e.g., a patient) by adjusting the voltages that are supplied to one or more sections of the high gradient lens, in addition to controlling the voltage ramping rates and properly synchronizing the on/off timing for the DWA charging switches. The MDWA that is configured this way to deliver the tightest spot provides a "baseline" performance for the charged particle beam system. In some applications, such as intensity modulated proton therapy, it is desirable to have the capability to deliver various spot sizes on the patient from shot to shot during a single treatment.

In accordance with the disclosed embodiments, the baseline performance of a particle accelerator can be modified (e.g., degraded) to increase the spot size from the baseline setting.

In some example embodiments, the injector subsystems of the particle accelerator system are slightly mismatched with the MDWA to produce a larger spot size than the baseline setting.

FIGS. 7(*a*) to 7(*f*) illustrate how a mismatch between the injected beam and the DWA can affect the output beam characteristics for an exemplary accelerator configuration. In particular, the plots in FIGS. 7(*a*) to 7(*f*) show the change in various output beam parameters at the target (e.g., at the patient's location) as a function of injected beam's envelop slope, r'. FIG. 7(*a*) illustrates that the output beam energy remains relatively constant as a function of injected beam's slope, whereas, as shown in FIG. 7(*b*), the energy of the output beam within plus and minus one standard deviation from the peak value, which is represented by "1−σ energy" along the vertical axis, drops off substantially linearly as a function of increasing slope of the injected beam. FIG. 7(*c*) illustrates the change in output beam radius at 100%, 95%, 90% and 85% points (e.g., 100% corresponds to a radius including 100% of the protons in the bunch, 95% corresponds to a radius including 95% of the protons in the bunch, etc.) as a function of the injected beam's envelop. FIG. 7(*d*) illustrates the output beam's r.m.s. envelope as a function of the injected beam's slope. In FIG. 7(*e*) the output beam's slope is plotted against the injected beam's slope. The significance of the output slope plot can be appreciated by noting that two beams with the same spot size on a patient's skin but with different beam slopes produce different spot sizes when the beam reaches the target, such a tumor, which is located inside the body of the patient. In FIG. 7(*f*), the output beam's Lapostolle emittance is plotted as a function of the injected beam's slope.

In some example embodiments, degrading the baseline performance can be additionally, or alternatively, accomplished by adjusting the synchronization between the traveling accelerating field and the charged particle bunch to allow the particle beam bunch to slip off the crest of the traveling wave field. This leads to a larger spot size and growth in emittance of the output beam. The amount of increase in the spot size and emittance growth both depend on how far the charged particle beam bunch has slipped from the crest. One approach to introduce a synchronization mismatch is to adjust the timing between the particle beam injector (e.g., at the input and/or output of the RFQ 106 that is illustrated in FIG. 1) and the MDWA of the particle accelerator.

Figure 8:
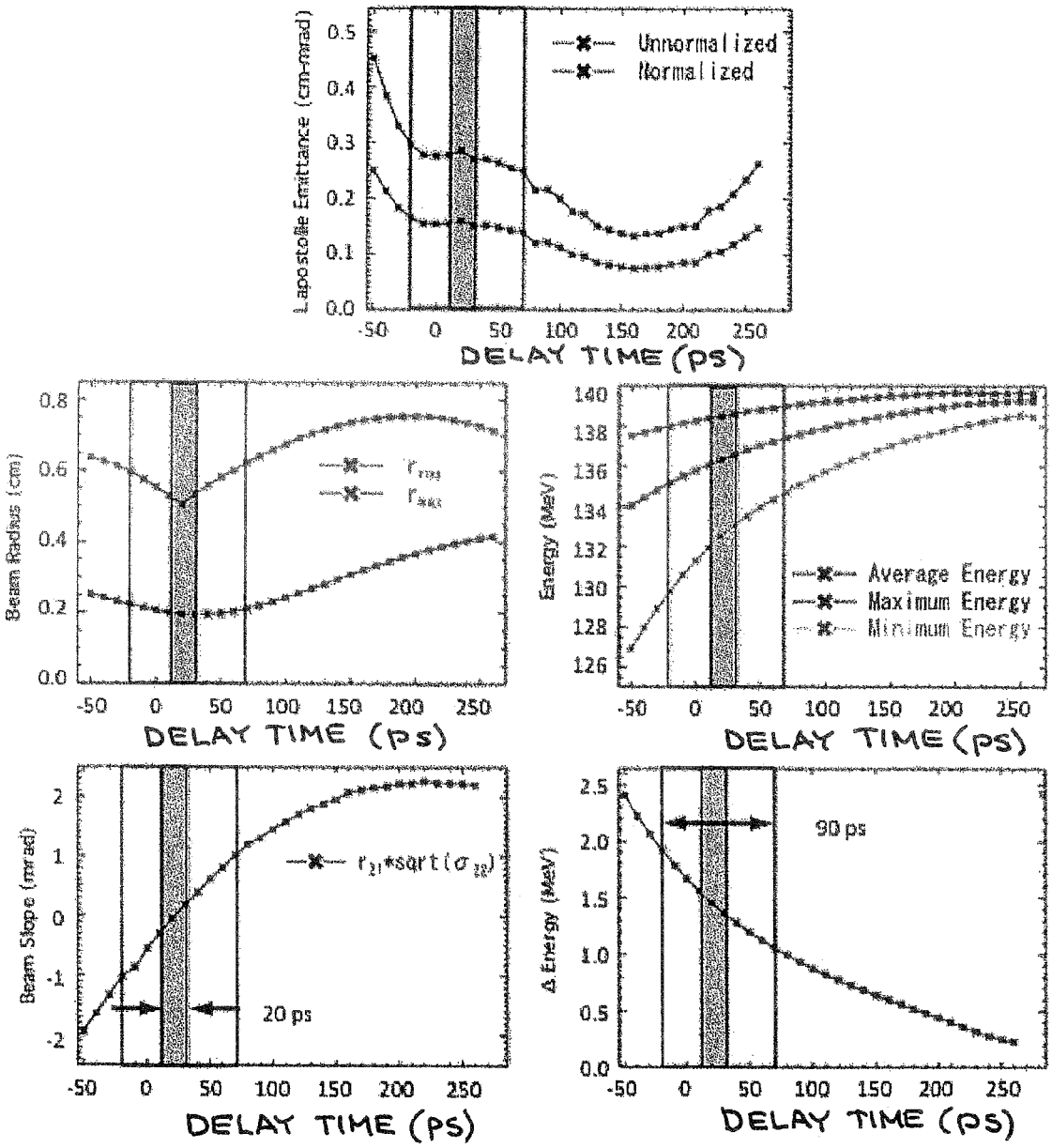
FIG. 8 illustrates changes in an output beam characteristics as a function of timing de-synchronization that can be produced in accordance with another exemplary embodiment of the described technology.
Figure 9A:
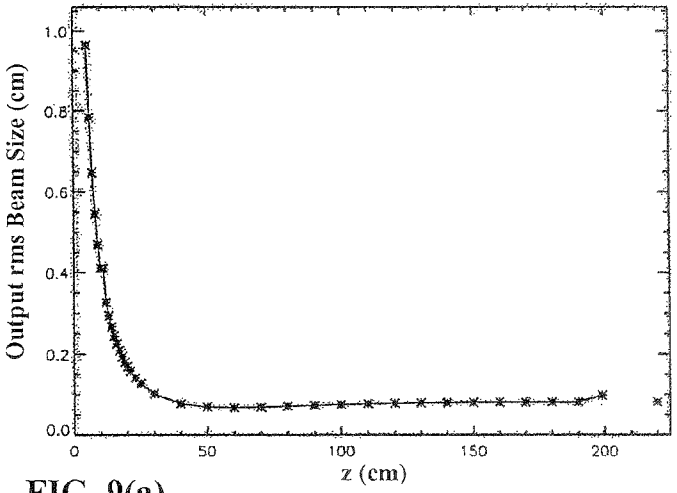
FIG. 9(*a*) is a plot of an output charged particle beam's r.m.s. size at a target location as a function of the location of a misfired Blumlein device that can be produced in accordance with an exemplary embodiment of the described technology.
Figure 9B:
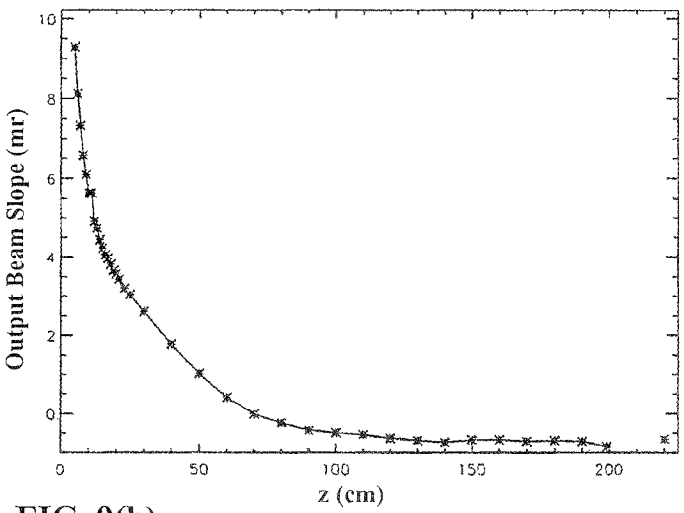
Figure 9C:
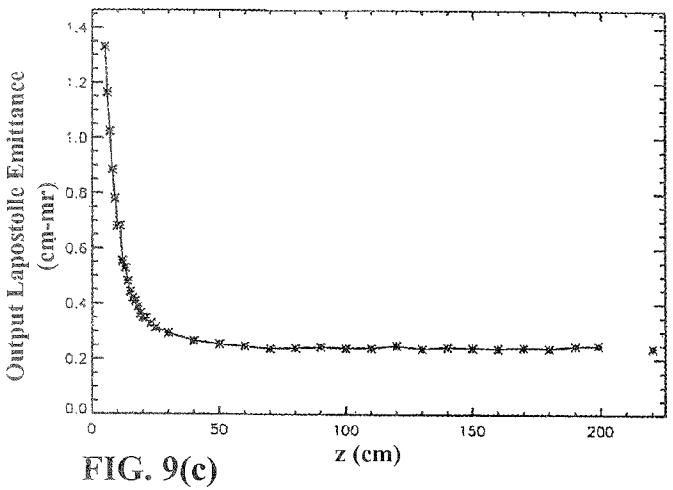
Figure 9D:
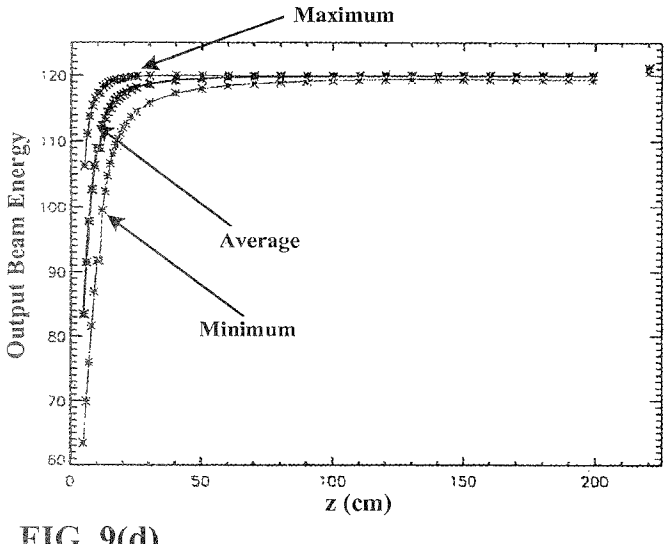

FIG. 8 illustrates the change in several output beam parameters as a function of timing delay between the injector and the DWA beams for an exemplary accelerator configuration. In particular, FIG. 8 shows the plots corresponding to Lapostolle emittance, beam radius, energy, beam slope and change in energy as a function of a delay time (i.e., delay time represents the time delay from a reference time value). It should be noted that the plots in FIG. 8 are not intended to necessarily convey that an optimum output beam parameter can be obtained when a particular timing delay is used. But rather these plots illustrate that changing the synchronization between the traveling accelerating field and the charged particle bunch can be used to modify different characteristics of the output beam from the baseline characteristics.

In some embodiments, degrading the baseline performance can be additionally, or alternatively, accomplished by adjusting the electric field at one or more sections of the DWA. For example, the transmission lines to a small portion of the MDWA can be turned off to slow down the charged particle beam bunch with respect to the traveling accelerating field. Due to high accelerating gradient in the MDWA, the effects of turning off a section of transmission lines at the low energy end of the MDWA can be significant.

For example, FIGS. 9(*a*) to 9(*d*) illustrate examples of changes in various output beam parameters as a function of the location of a misfired Blumlein block. In the plots of FIGS. 9(*a*) to 9(*d*), each Blumlein block is associated with a 2-cm section of the MDWA. FIGS. 9(*a*), 9(*b*) and 9(*c*) illustrate the r.m.s. beam size, the beam slope and the Lapostolle emittance, respectively, of the output beam at a target location as a function of the location of the misfired Blumlein block within the MDWA. In FIG. 9(*d*), the maximum, the minimum and the average output beam energies are plotted. Examination of FIGS. 9(*a*) to 9(*d*) reveals that the largest change in output beam characteristics occurs when a Blumlein block at the low energy end of the MDWA (e.g., less than 50 cm from the entrance of the MDWA) misfires.

Therefore, in some embodiments, to produce spot sizes that are larger than the baseline spot size, charging voltages at one or more sections of the MDWA are either completely turned off or set to a value that is different from the baseline setting. When the charging voltages are turned off or modified from their baseline setting, the energy of the output beam is also decreased.

In some embodiments, to compensate for the aforementioned lost energy, an additional DWA section can be added to the end of the MDWA to increase the energy of the charged particles. With reference to FIG. 4, an end section 406 of the MDWA 400 is illustrated that is constructed using alternate layers of insulators and conductors, as in other sections of the MDWA 400. In one particular example embodiment, the end section 406 is 2 cm long, the DWA main section 404 is 180 cm long, and the high gradient lens 402 is 20 cm long. The end section 406 of the MDWA 400 can be used to increase the energy of the transported beam. In particular, the transmission lines that supply voltages to the end section 406 of the MDWA 400 can remain in the "off" state (or a first state that allows the particle accelerator to operate in a baseline configuration) when baseline performance is needed. However, depending on the number and locations of the MDWA sections that were turned off for non-baseline beam transport, the transmission lines to one or more sections of the end section 406 can be energized to compensate for the lost energy of the charged particle beam. It should be noted that the end section 406 can also be used to compensate for energy loss when non-baseline performance is produced using other previously described techniques, such as when adjustments are made to create a slightly out-of-sync traveling accelerating field and charged particle bunch, and/or when the injector and the MDWA are slightly mismatched.

In FIG. 4, the transmission lines 408 supply voltages to one or more sections of the combined MDWA and are under the control of a timing/control component, which may be implemented as part of the timing and control components 116 that is illustrated in FIG. 1. Alternatively, or additionally, separate control components may be used to control each section of the MDWA 400. Using the control and timing components, one or more voltage sources can be configured to supply a desired voltage value to each section and/or subsection of the MDWA to establish the desired longitudinal and transverse electric fields. During the baseline operation, the timing and control signals can, for example, enable focusing and acceleration of the charged particle beam as is propagates through the high gradient lens portion of the MDWA, provide pulses to the DWA main section in synchronization with the charged particle bunch, and/or to configure the end portion of the MDWA to produce a charged particle beam with desired baseline characteristics.

To allow variations in the output charged particle beam characteristics (e.g., increase the output beam size), the timing and control components can configure one or more voltage sources to supply different voltage values to certain transmission lines of the MDWA to, for example, enable defocusing and deceleration of the charged particle beam as it propagates through the high gradient lens portion of the MDWA, provide pulses to the MDWA that are slightly out of synchronization with the charged particle bunch, and/or to configure the end portion of the MDWA to, for example, compensate for energy loss in the charged particle beam. The change in output beam characteristics can include, but is not limited to, changes in the beam energy, beam spot size, beam slope, beam emittance, beam uniformity, beam intensity and the like.

Figure 10:
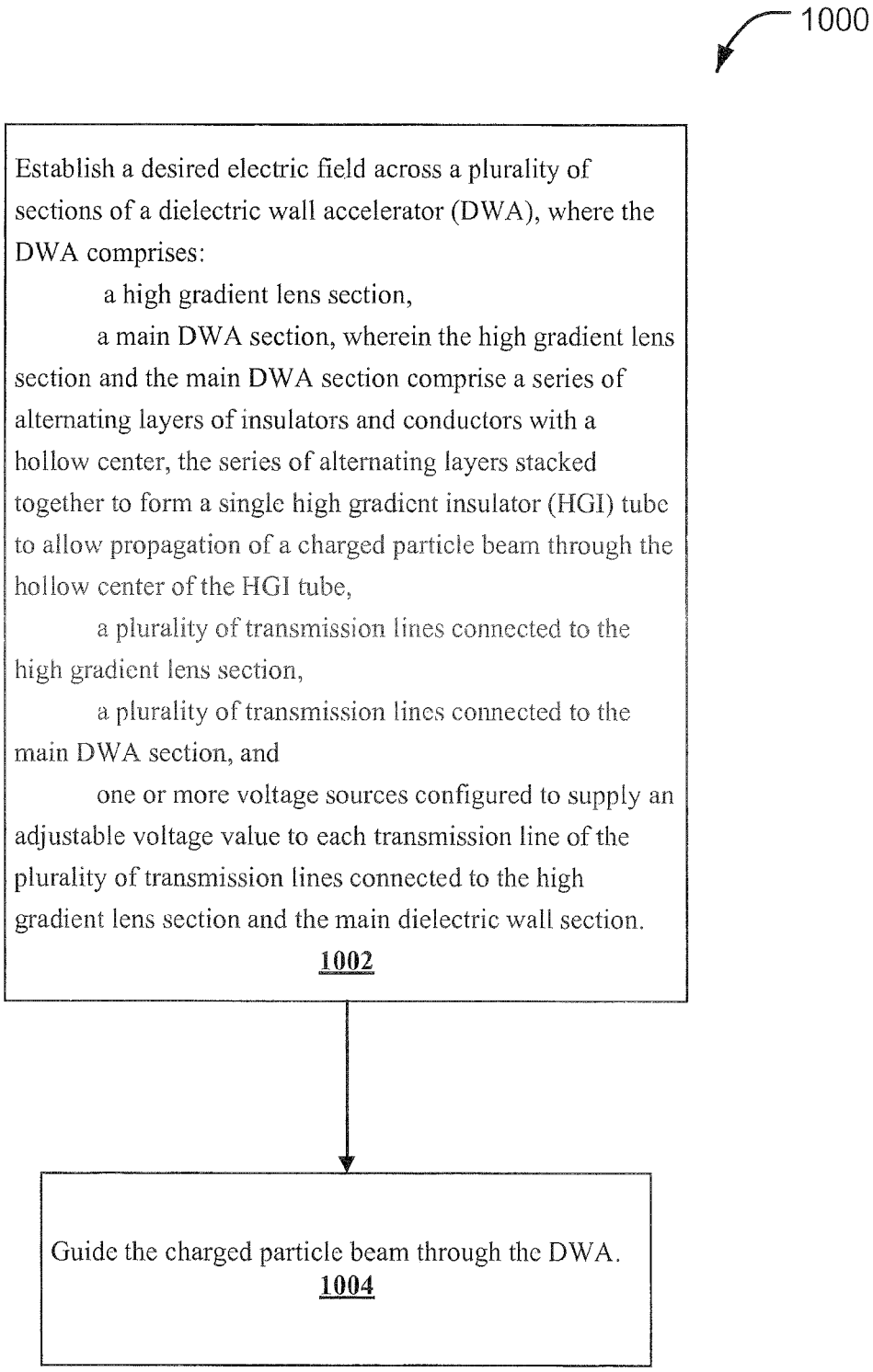
FIG. 10 illustrates a set of operations for shaping a charged particle beam in accordance with an exemplary embodiment of the described technology.

FIG. 10 illustrates a set of operations, generally indicated at 1000, for shaping a charged particle beam in accordance with an exemplary embodiment. At 1002, a desired electric field across a plurality of sections of a dielectric wall accelerator (DWA) is established. The DWA comprises a high gradient lens section and a main DWA section, where the high gradient lens section and the main DWA section comprise a series of alternating layers of insulators and conductors with a hollow center, the series of alternating layers stacked together to form a single high gradient insulator (HGI) tube to allow propagation of a charged particle beam through the hollow center of the HGI tube. The DWA further comprises a plurality of transmission lines connected to the high gradient lens section, a plurality of transmission lines connected to the main DWA section, and one or more voltage sources configured to supply an adjustable voltage value to each transmission line of the plurality of transmission lines connected to the high gradient lens section and the main dielectric wall section. At 1004, the charged particle beam is guided through the DWA.

Figure 11:
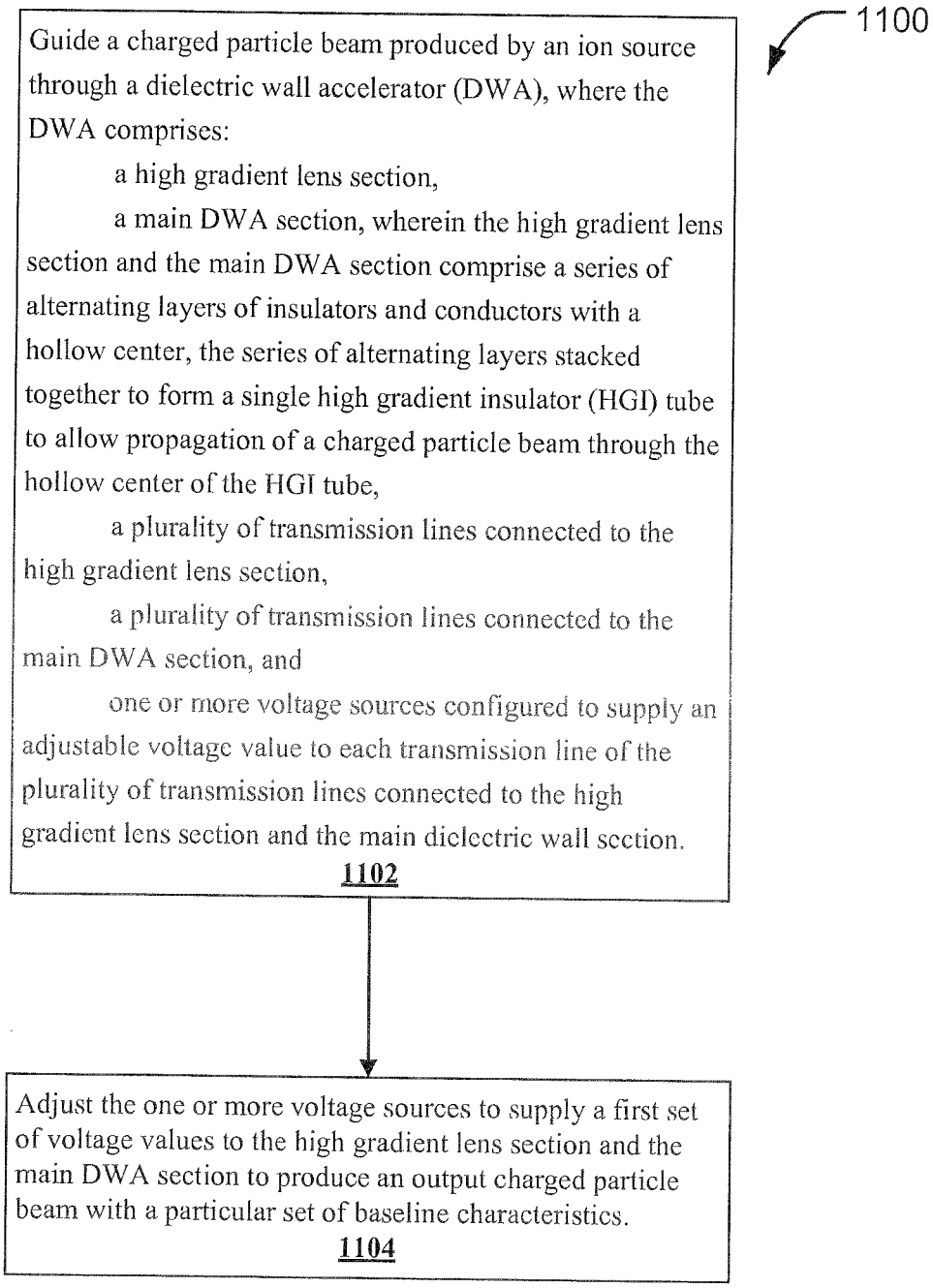
FIG. 11 illustrates a set of operations for operating charged particle accelerator system in accordance with an exemplary embodiment of the described technology.

FIG. 11 illustrates a set of operations, generally indicated at 1100, for operating a charged particle beam accelerator in accordance with an exemplary embodiment. At 1102, a charged particle beam produced by a charged particle source is guided or otherwise directed through a dielectric wall accelerator (DWA). The DWA comprises a high gradient lens section and a main DWA section, where the high gradient lens section and the main DWA section comprise a series of alternating layers of insulators and conductors with a hollow center, the series of alternating layers stacked together to form a single high gradient insulator (HGI) tube to allow propagation of a charged particle beam through the hollow center of the HGI tube. The DWA also includes a plurality of transmission lines connected to the high gradient lens section, a plurality of transmission lines connected to the main DWA section, and one or more voltage sources configured to supply an adjustable voltage value to each transmission line of the plurality of transmission lines connected to the high gradient lens section and the main dielectric wall section. At 1104, the one or more voltage sources are adjusted to supply a first set of voltage values to the high gradient lens section and the main DWA section to produce an output charged particle beam with a particular set of baseline characteristics where the output beam spot size is at or near the smallest beam spot size. In controlling the beam spot size, various control operations may be used to vary the beam spot size from the baseline beam spot size. For example, a second set of voltage values different from the first set of voltage values for the baseline characteristics of the beam can be applied to produce a larger output beam size than the baseline beam size. For another example, the timing between the traveling accelerating field and the charge particle beam may be controlled to deviate from the synchronization state for the DWA to produce a larger output beam size than the baseline beam size. For yet another example, the parameter of the beam incident to the DWA can be changed to produce a larger output beam size by the DWA.

Figure 12:
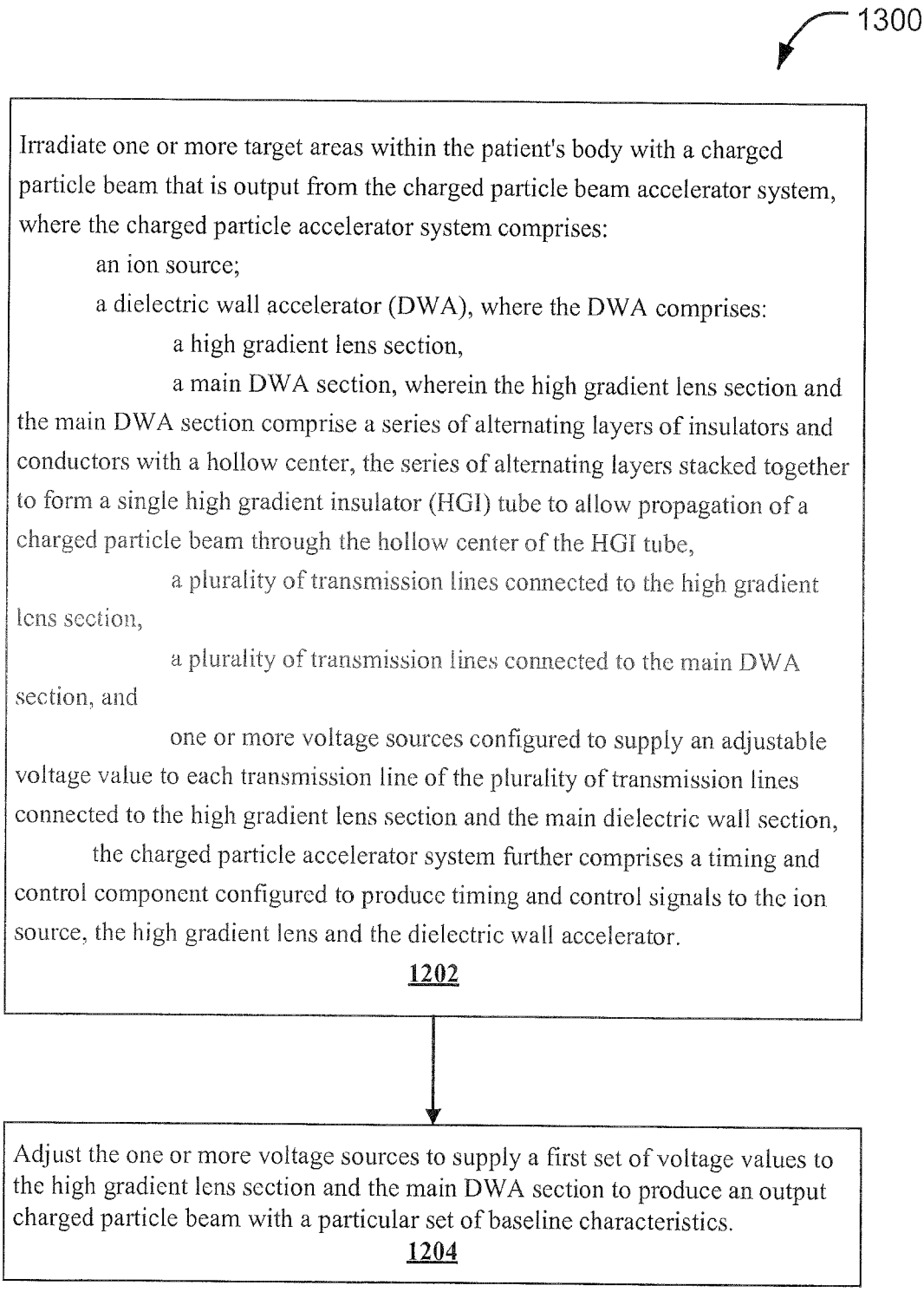
FIG. 12 illustrates a set of operations for treatment of a patient using a charged particle accelerator system in accordance with an exemplary embodiment of the described technology.

FIG. 12 illustrates a set of operations, generally indicated at 1200, for treatment of a patient using a charged particle accelerator system in accordance with an exemplary embodiment. At 1202, one or more target areas within the patient's body are irradiated with a charged particle beam that is output from the charged particle beam accelerator system. The charged particle beam system comprises a charged particle source such as an exemplary ion source, a dielectric wall accelerator (DWA). The DWA comprises a high gradient lens section, a main DWA section, where the high gradient lens section and the main DWA section comprise a series of alternating layers of insulators and conductors with a hollow center, the series of alternating layers stacked together to form a single high gradient insulator (HGI) tube to allow propagation of a charged particle beam through the hollow center of the HGI tube. The DWA also includes a plurality of transmission lines connected to the high gradient lens section, a plurality of transmission lines connected to the main DWA section, and one or more voltage sources configured to supply an adjustable voltage value to each transmission line of the plurality of transmission lines connected to the high gradient lens section and the main dielectric wall section. The charged particle accelerator system further comprises a timing and control component configured to produce timing and control signals to the ion source, the high gradient lens and the dielectric wall accelerator. At 1204, one or more voltage sources are adjusted to supply a first set of voltage values to the high gradient lens section and the main DWA section to produce an output charged particle beam with a particular set of baseline characteristics.

It is understood that the various embodiments of the present disclosure may be implemented individually, or collectively, in devices comprised of various hardware and/or software modules and components. In describing the disclosed embodiments, sometimes separate components have been illustrated as being configured to carry out one or more operations. It is understood, however, that two or more of such components can be combined together and/or each component may comprise sub-components that are not depicted. Further, the operations that are described in the form of the flow charts in FIGS. 10 through 12 may include additional steps that may be used to carry out the various disclosed operations.

Figure 13:
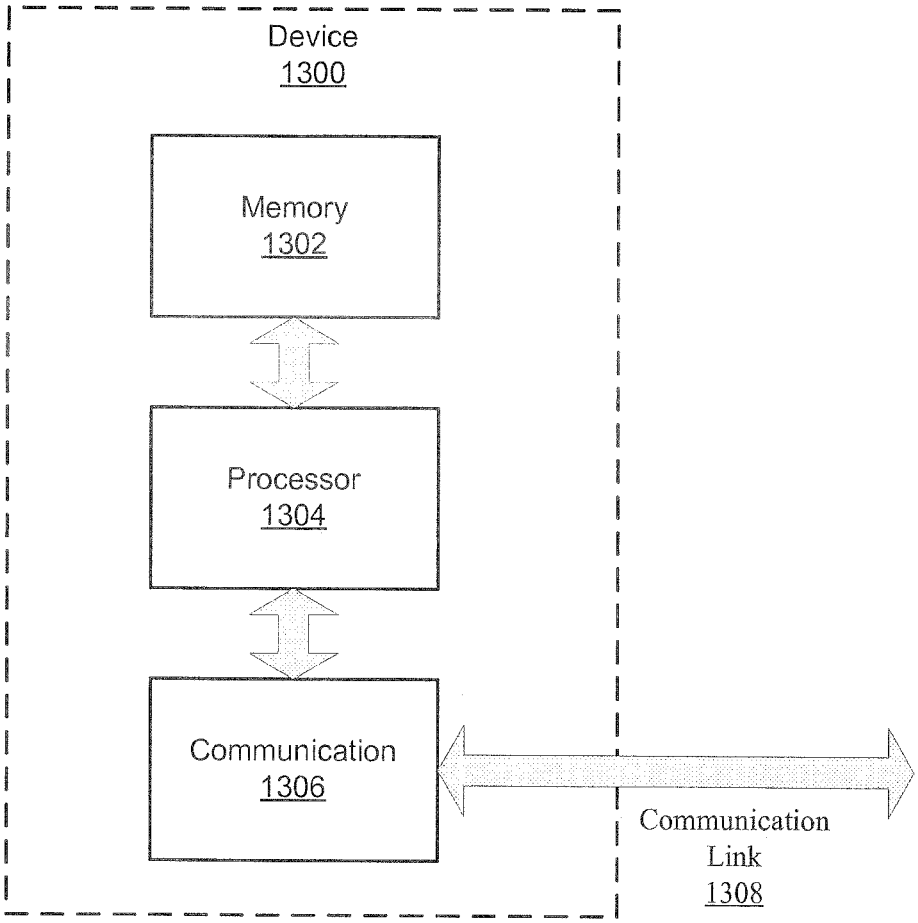
FIG. 13 illustrates a simplified diagram of a device that can be used to control the operations of the components of the disclosed embodiments of the described technology.

In some examples, the devices that are described in the present application can comprise a processor, a memory unit and an interface that are communicatively connected to each other. For example, FIG. 13 illustrates a block diagram of a device 1300 that can be utilized as part of the timing and control components 116 of FIG. 1, or may be communicatively connected to one or more of the components of FIG. 1. In some example embodiments, the device 1300 may be used to control the timing and the value of voltages that are applied to the high gradient lens that is described in the present application. The device 1300 comprises at least one processor 1302 and/or controller, at least one memory 1304 unit that is in communication with the processor 1302, and at least one communication unit 1306 that enables the exchange of data and information, directly or indirectly, through the communication link 1308 with other entities, devices, databases and networks. The communication unit 1306 may provide wired and/or wireless communication capabilities in accordance with one or more communication protocols, and therefore it may comprise the proper transmitter/receiver antennas, circuitry and ports, as well as the encoding/decoding capabilities that may be necessary for proper transmission and/or reception of data and other information.

Various embodiments described herein are described in the general context of methods or processes, which may be implemented in one embodiment by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), Blu-ray Discs, etc. Therefore, the computer-readable media described in the present application include non-transitory storage media. Generally, program modules may include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Only a few implementations and examples are described and other implementations, enhancements and variations can be made based on what is described and illustrated in this patent document. For example, the exemplary embodiments have been described in the context of proton beams. It is, however, understood that the disclosed principals can be applied to other charged particle beams. Moreover, the modification and shaping of charged particle pulses that are carried out in accordance with certain embodiments may be used in a variety of applications that range from radiation for cancer treatment, probes for spherical nuclear material detection or plasma compression, or in acceleration experiments. The features of the embodiments described herein may be combined in all possible combinations of methods, apparatus, modules, systems, and computer program products.

What is claimed is:

1. A charged particle accelerator system comprising:

a dielectric wall accelerator (DWA) including:

a high gradient lens section that transports a charged particle beam and controls a beam spot size of the charged particle beam;

a main DWA section that accelerates the charged particle beam, wherein the high gradient lens section and the main DWA section comprise a series of alternating layers of insulators and conductors with a hollow center, the series of alternating layers stacked together to form a single high gradient insulator (HGI) tube to allow propagation of the charged particle beam through the hollow center of the HGI tube;

a plurality of transmission lines connected to the high gradient lens section;

a plurality of transmission lines connected to the main DWA section; and one or more voltage sources configured to supply an adjustable voltage value to each transmission line of the plurality of transmission lines connected to the high gradient lens section and the main DWA section to establish an adjustable electric field profile.

2. The charged particle accelerator system of claim 1, further comprising:

a charged particle source configured to produce the charged particle beam, and the DWA configured to receive, dynamically shape and accelerate the charged particle beam from the charged particle source; and a timing and control component configured to produce timing and control signals to the charged particle source and the DWA via the transmission lines.

3. The charged particle accelerator system of claim 1, wherein the one or more voltage sources are configured to establish a substantially linear longitudinal electric field within the high gradient lens section.

4. The charged particle accelerator system of claim 3, wherein the substantially linear longitudinal electric field increases monotonically as a function of distance from entrance of the high gradient lens section.

5. The charged particle accelerator system of claim 3, wherein the substantially linear longitudinal electric field decreases monotonically as a function of distance from an entrance of the high gradient lens section.

6. The charged particle accelerator system of claim 1, wherein the one or more voltage sources are configured to establish a radial electric field at one or more subsections within the high gradient lens section and to thereby focus or defocus the charged particle beam propagating through the HGI tube.

7. The charged particle accelerator system of claim 6, wherein the one or more voltage sources are configured to establish at least one of:

a positive valued radial electric field to focus a positively charged particle beam;

a positive valued radial electric field to defocus a negatively charged particle beam;

a negative valued radial electric field to focus a negatively charged particle beam; or a negative valued radial electric field to defocus a positively charged particle beam.

8. The charged particle accelerator system of claim 1, wherein the one or more voltage sources are configured to supply a first set of voltage values to the high gradient lens section and the main DWA section to produce an output charged particle beam with a particular set of baseline characteristics.

9. The charged particle accelerator system of claim 8, wherein producing an output charged particle beam with a set of baseline characteristics includes producing a minimum output beam spot size at a target location.

10. The charged particle accelerator system of claim 8, wherein the baseline characteristics comprises a beam radius, a beam spot size, a beam energy, a beam emittance, a beam uniformity, a beam intensity, and a beam slope.

11. The charged particle accelerator system of claim 8, wherein the one or more voltage sources are configured to supply a second voltage value to at least one subsection of the main DWA section such that the second voltage value is different from a first voltage value supplied to the at least one subsection to produce the particular set of baseline characteristics.

12. The charged particle accelerator system of claim 11, wherein the second voltage value is zero.

13. The charged particle accelerator system of claim 8, wherein the one or more voltage sources are configured to supply a second voltage value to at least one subsection of the high gradient lens section such that the second voltage value is different from a first voltage value supplied to the at least one subsection to produce the particular set of baseline characteristics.

14. The charged particle accelerator system of claim 1, wherein the DWA further comprises:

an end section comprise a series of alternating layers of insulators and conductors with a hollow center, the series of alternating layers stacked together with the alternating layers of insulators and conductors associated with the high gradient lens section and the main DWA section to form the single high gradient insulator (HGI) tube; and a plurality of transmission lines connected to the end section, wherein the one or more voltage sources are configured to supply an adjustable voltage value to each transmission line of the plurality of transmission lines connected to the end section.

15. The charged particle accelerator system of claim 14, wherein the one or more voltage sources are configured to supply a voltage value to at least one subsection of the end section and to thereby increase the charged particle beam energy.

16. The charged particle accelerator system of claim 14, wherein the plurality of transmission lines connected to each of the high gradient lens section, the main DWA section and the end section are configured to be independently adjusted.

17. A method of shaping a charged particle beam, comprising:

establishing a desired electric field across a plurality of sections of a dielectric wall accelerator (DWA), wherein the DWA comprises:

a high gradient lens section, a main DWA section, wherein the high gradient lens section and the main DWA section comprise a series of alternating layers of insulators and conductors with a hollow center, the series of alternating layers stacked together to form a single high gradient insulator (HGI) tube to allow propagation of a charged particle beam through the hollow center of the HGI tube, a plurality of transmission lines connected to the high gradient lens section, a plurality of transmission lines connected to the main DWA section, and one or more voltage sources configured to supply an adjustable voltage value to each transmission line of the plurality of transmission lines connected to the high gradient lens section and the main dielectric wall section to establish an adjustable electric field profile; and directing the charged particle beam through the DWA.

18. The method of claim 17, wherein establishing the desired electric field comprises adjusting the one or more voltage sources to establish a substantially linear longitudinal electric field within the high gradient lens section.

19. The method of claim 18, wherein the substantially linear longitudinal electric field increases monotonically as a function of distance from entrance of the high gradient lens section.

20. The method of claim 18, wherein the substantially linear longitudinal electric field decreases monotonically as a function of distance from entrance of the high gradient lens section.

21. The method of claim 17, wherein establishing the desired electric field comprises adjusting the one or more voltage sources to establish a radial electric field at one or more subsections within the high gradient lens section and to thereby focus or defocus the charged particle beam propagating through the HGI tube.

22. The method of claim 21, wherein adjusting the one or more voltage sources establishes at least one of:

a positive valued radial electric field to focus a positively charged particle beam;

a positive valued radial electric field to defocus a negatively charged particle beam;

a negative valued radial electric field to focus a negatively charged particle beam; or a negative valued radial electric field to defocus a positively charged particle beam.

23. The method of claim 17, wherein establishing the desired electric field comprises adjusting the one or more voltage sources to supply a first set of voltage values to the high gradient lens section and the main DWA section to produce an output charged particle beam with a particular set of baseline characteristics.

24. The method of claim 23, wherein producing the output charged particle beam with the particular set of baseline characteristics includes producing a minimum output beam spot size at a target location.

25. The method of claim 23, wherein the baseline characteristics comprises a beam radius, a beam spot size, a beam energy, a beam emittance, a beam uniformity, a beam intensity, and a beam slope.

26. The method of claim 23, further comprising adjusting the one or more voltage sources to supply a second voltage value to at least one subsection of the main DWA section such that the second voltage value is different from a first voltage value supplied to the at least one subsection to produce the particular set of baseline characteristics.

27. The method of claim 26, wherein the second voltage value is zero.

28. The method of claim 23, further comprising adjusting the one or more voltage sources to supply a second voltage value to at least one subsection of the high gradient lens section such that the second voltage value is different from a first voltage value supplied to the at least one subsection to produce the particular set of baseline characteristics.

29. The method of claim 23, further comprising adjusting the one or more voltage sources to supply a second set of voltage values to the high gradient lens section or the main DWA section to produce an output charged particle beam with a set of characteristics different from the baseline characteristics.

30. The method of claim 29, wherein the second set of voltage values produces an output charged particle beam that is different from the output charged particle beam with the particular set of baseline characteristics in at least one of: a beam radius, a beam spot size, a beam energy, a beam emittance, a beam uniformity, a beam intensity, and a beam slope.

31. The method of claim 17, further comprising adjusting the one or more voltage sources to supply a voltage value to at least one subsection of an end section of the DWA to increase the charged particle beam energy, wherein the end section comprises a series of alternating layers of insulators and conductors with a hollow center, the series of alternating layers stacked together with the alternating layers of insulators and conductors associated with the high gradient lens section and the main DWA section to form the single high gradient insulator (HGI) tube; and wherein a plurality of transmission lines are connected to the end section; and wherein the one or more voltage sources are configured to supply an adjustable voltage value to each transmission line of the plurality of transmission lines connected to the end section.

32. The method of claim 17, further comprising introducing a timing offset to de-synchronize the charged particle beam that enters the HGI tube and sequence of voltage values applied to the main DWA section to produce an output charged particle beam with a set of characteristics different from the baseline characteristics.

33. The method of claim 17, further comprising introducing, at entrance to the DWA, a mismatch between the charged particle beam characteristics and the DWA to produce an output charged particle beam with a set of characteristics different from the baseline characteristics.

34. A method for treatment of a patient using a charged particle accelerator system, the method comprising:

irradiating one or more target areas within the patient's body with a charged particle beam that is output from the charged particle beam accelerator system, the charged particle accelerator system comprising:

a charged particle source;

a dielectric wall accelerator (DWA), wherein the DWA comprises:

a high gradient lens section, a main DWA section, wherein the high gradient lens section and the main DWA section comprise a series of alternating layers of insulators and conductors with a hollow center, the series of alternating layers stacked together to form a single high gradient insulator (HGI) tube to allow propagation of a charged particle beam through the hollow center of the HGI tube, a plurality of transmission lines connected to the high gradient lens section, a plurality of transmission lines connected to the main DWA section, and one or more voltage sources configured to supply an adjustable voltage value to each transmission line of the plurality of transmission lines connected to the high gradient lens section and the main dielectric wall section to establish an adjustable electric field the charged particle accelerator system further comprising a timing and control component configured to produce timing and control signals to the charged particle source, the high gradient lens and the dielectric wall accelerator; and adjusting the one or more voltage sources to supply a first set of voltage values to the high gradient lens section and the main DWA section to produce an output charged particle beam with a particular set of baseline characteristics.

35. The method of claim 34, wherein producing the output charged particle beam with the particular set of baseline characteristics includes producing a minimum output beam spot size at a target location.

36. The method of claim 34, wherein the baseline characteristics comprises a beam radius, a beam spot size, a beam energy, a beam emittance, a beam uniformity, a beam intensity, and a beam slope.

37. The method of claim 34, further comprising irradiating the one or more target areas within the patient's body with a modified charged particle beam with a set of characteristics different from the baseline characteristics.

38. The method of claim 37, wherein the modified charged particle beam is produced by adjusting the one or more voltage sources to supply a second set of voltage values to the high gradient lens section or the main DWA section.

39. The method of claim 37, wherein the modified charged particle beam is produced by introducing a timing offset to de-synchronize the charged particle beam that enters the HGI tube and sequence of voltage values applied to the main DWA section.

40. The method of claim 37, wherein the modified charged particle beam is produced by introducing, at entrance to the DWA, a mismatch between the charged particle beam characteristics and the DWA.

* * * * *